United States Patent [19]

Koester et al.

[11] Patent Number: 5,025,969

[45] Date of Patent: Jun. 25, 1991

[54] DUAL ACTUATION STAPLE INSERTION APPARATUS

[76] Inventors: William L. Koester, R.R. #1, Box 232; Daniel L. Koester, R.R. #1, Box 232A, both of, Poseyville, Ind. 47633

[21] Appl. No.: 232,151

[22] Filed: Aug. 15, 1988

Related U.S. Application Data

[63] Continuation-in-part of Ser. No. 48,739, May 11, 1987, Pat. No. 4,826,066.

[51] Int. Cl.[5] ..... B25L 1/102

[52] U.S. Cl. ..... 227/120; 47/9; 47/56; 111/106; 111/200; 227/129; 227/134; 227/147

[58] Field of Search ..... 47/9, 56; 111/106, 200; 227/120, 156, 129, 147, 134

[56] References Cited

U.S. PATENT DOCUMENTS

| | | | |
|---|---|---|---|
| 1,441,474 | 1/1923 | Anderson | 227/129 X |
| 1,919,944 | 7/1933 | Hicks | 227/129 X |
| 3,035,269 | 5/1962 | Latsch et al. | 227/134 X |
| 3,890,910 | 6/1975 | Angruner | 47/56 X |
| 4,139,136 | 2/1979 | Catalano | 227/147 X |
| 4,377,919 | 3/1983 | Gams | 111/106 X |
| 4,627,563 | 12/1986 | Meyer | 227/120 X |
| 4,706,864 | 11/1987 | Jacobsen et al. | 227/109 |

*Primary Examiner*—Paul A. Bell
*Attorney, Agent, or Firm*—Roger H. Flagg

[57] ABSTRACT

A dual actuation staple insertion apparatus, for sequentially inserting a plurality of staples through a selected material, into the ground when actuated by a downward force from an operator upon opposing handles, foot actuation member or both. The apparatus comprises a housing with a bottom, sides and a top forming a chamber therebetween, with open end portions. A tubular member is secured to the housing, and a drive means is slidably received in the tubular member. A biasing member is disposed upon the drive means above the tubing, and acts against a stop to raise the drive means to an upper operating position. A staple advancing means urges the plurality of staples into position beneath the drive means, in preparation for the next staple insertion.

20 Claims, 3 Drawing Sheets

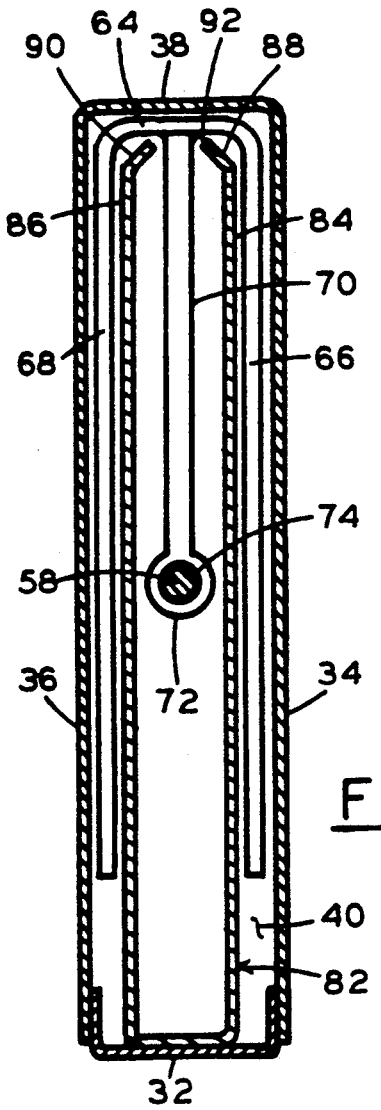
FIG. 3
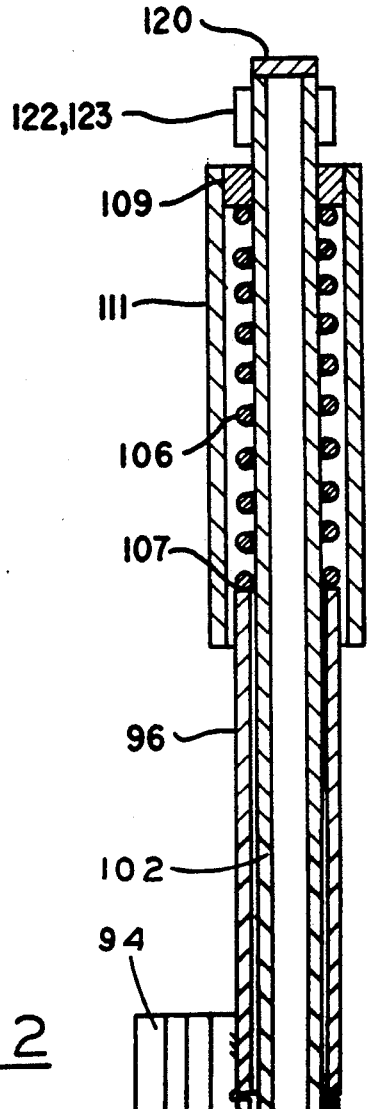
FIG. 2
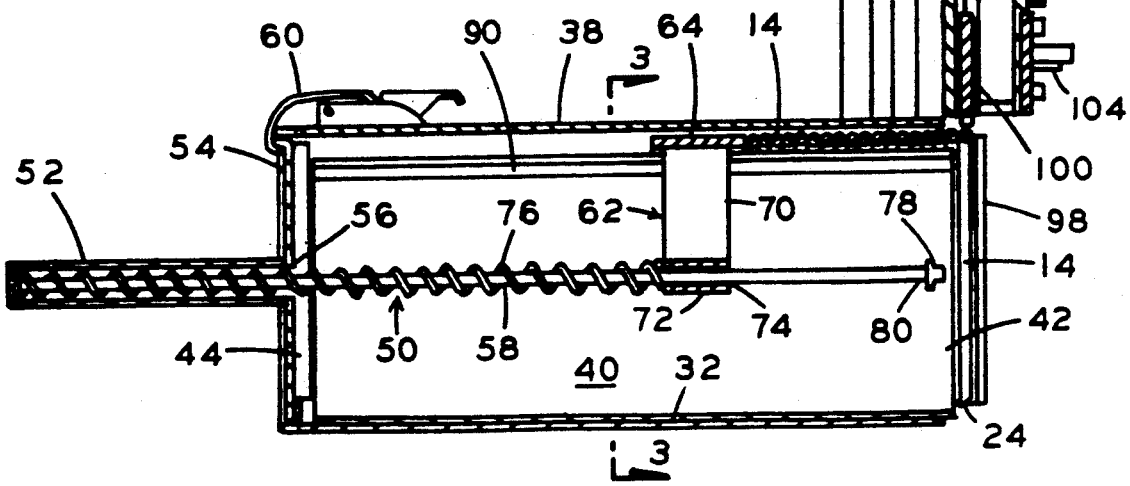

DUAL ACTUATION STAPLE INSERTION APPARATUS

This application is a continuation-in-part of pending application Ser. No. 07/048,739 filed May 11, 1987 now U.S. Pat. No. 4,826,066. The specification and drawings of Ser. No. 07/048,789 are incorporated by reference herein.

FIELD OF THE INVENTION

This invention relates to staple insertion apparatus, and more particularly to an apparatus for sequentially inserting large, generally U-shaped staples through agricultural mats, erosion control mats, or other sheet like material, into the ground, by manual force generated by the user's hands, foot or a combination of hand and foot actuation.

BACKGROUND OF THE INVENTION

There are may known applications where it is desirable to stake or staple large mat or sheet materials to the ground, in order to improve growing conditions, or to control soil erosion, or the like. Some mat materials may incorporate seeds, fertilizers, or various forms of week control to improve growing conditions. Mat or sheet material may be employed to control soil erosion. The mat or sheet material is tailored to follow the uneven contour of the ground.

The insertion of stakes or staples through the mat or sheet material into the ground at suitable spaced intervals, serves to retain the material in place against the effects of wind, water and other elements. Manual insertion of stakes or staples may be accomplished by foot actuation as disclosed in my pending application Ser. No. 048,789 filed May 11, 1987 now U.S. Pat No. 4,826,066. Alternately, the pending application discloses an apparatus for inserting staples either by foot actuation, by hand actuation, or by a combination of hand and foot actuation.

RELEVANT PRIOR ART

U.S. Pat. No. 4,706,864 discloses a fastener implanting machine actuated by foot pressure wherein a spring extends over a pulley to raise the driver when the operator is not exerting foot pressure on the foot pedal. The fasteners disclosed are not U-shaped fasteners, but utilize a shorter leg and a longer leg: or two shorter legs and a centrally disposed longer leg.

U.S. Pat. No. 4,377,919 discloses a hold down system for horticultural plastic sheet, which employs "T", "L" or inverted "W" shaped fasteners, which are manually positioned and inserted into the ground with a driving tool utilizing a combination of foot and hand power.

U.S. Pat. No. 3,890,910 discloses an air powered staple insertion apparatus, actuated by a foot valve, to pneumatically drive the staple into the ground.

SUMMARY OF THE INVENTION

The staple insertion apparatus disclosed herein utilizes the manual force of the operator's hands, or the operator's foot, or a combination of the operator's hands and foot, to drive a large U-shaped staple through a mat or sheet, into the ground to secure and retain the material against the ground.

The U-shaped staples are preferably secured together in an aligned, juxtaposed relation for ease of handling and insertion of a plurality of staples into the staple insertion chamber.

The operator positions the apparatus upon the mat or sheet material, and utilizes hand or foot pressure, or both, to bias the drive member against the forward most staple positioned beneath the drive member, into the ground. As the operator releases downward pressure against the handle or foot acuation member, a spring member raises the drive member into a first operating position, whereupon the plurality of staples in the chamber are biased to align the next adjacent staple beneath the drive member in preparation for the next staple insertion.

A chamber protects the staples during use, by enclosing the staples between the top, bottom and sides of the housing.

Other features and objects of this invention, and the manner of attaining them will be best understood by reference to the following description of an embodiment of the invention, when considered in conjunction with the accompanying drawings.

BRIEF DESCRIPTION OF THE DRAWINGS

FIG. 2 is a cross sectional view of the staple insertion apparatus, with the staple advancing apparatus releasably secured within the housing.

FIG. 3 is a cross sectional view of the housing, taken along lines 3—3 in FIG. 2.

BEST MODE FOR CARRYING OUT THE INVENTION

Figure 1:
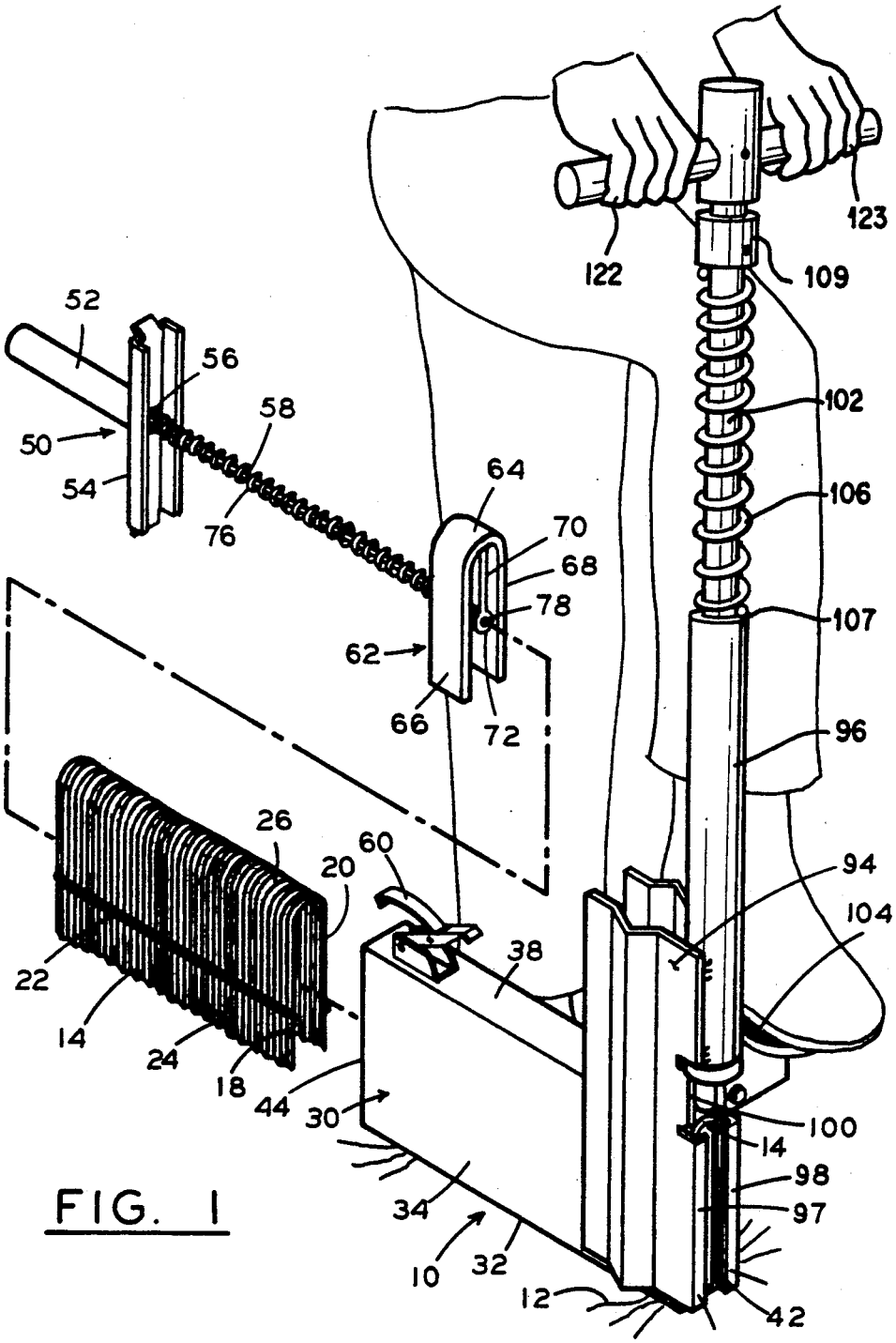
FIG. 1 shows a perspective view of the staple insertion apparatus, with the staple advancing means and a plurality of staples shown in exploded view.

The subject matter which I regard as my invention is particularly pointed out and distinctly claimed in the claims. The structure and operation of my invention, together with further objects and advantages, may be better understood from the following description given in connection with the accompanying drawings, in which:

FIG. 1 shows the staple insertion apparatus 10, positioned upon a large portion of selected material 12. Operator 13 grasps handle 15 in preparation for insertion of a staple 14 through the selected material 12, into the ground (not shown). A plurality of staples 14 are shown in exploded view, in aligned, juxtaposed relation. For ease of handling and insertion, staples 14 are preferably secured together by one or more traverse strips 22 secured to each staple 14. The ends 24 of each staple 14 are preferably pointed to aid insertion of staple 14 into the ground. Each staple 14 may be formed from wire, strip, or sheet material into a generally U-shaped configuration having a top portion 26, with depending side portions 18, 20. The adjoining top 26 and side portions 18, 20 of each staple 14 are preferably radiused to avoid stress concentration during insertion.

The staple insertion apparatus 10 of FIG. 1–4 comprises an elongated, horizontally disposed housing 30 having a bottom portion 82, opposing side portions 34, 36 adjacent to the bottom portion 32, and a top portion 38 adjacent to the side portions 34, 36 forming a chamber 40 therebetween. Chamber 40 is sized to slidably receive a plurality of staples 14 therein.

The opposing ends of chamber 40 form a first open end portion 42 and a second open end portion 44. The plurality of staples 14 are inserted through second open end portion 44, and are biased by staple advancing means 50 towards the first open end portion 42.

As best shown in FIG. 1 and FIG. 3, the staple advancing means 50 preferably comprises a tubular handle portion 52 extending externally from an end closure member 54 having an aperture 56 therethrough. An elongated rod 58 is secured at one end in spaced relation within tubular handle portion 52, and extends in spaced relation through aperture 56 in closure member 54. When the staple advancing means 50 is secured in proximity to the second open end portion 44 of chamber 40 by retaining means 60, elongated rod 58 is sized to extend substantially the length of chamber 40, as shown in FIG. 3.

Staple guide means 62 is sized to be slidably received within chamber 40, and to abut the staple 14 closest to the second open end portion 44. As best shown in FIG. 8, staple guide means 62 preferably comprises a top portion 64, and adjoining side portions 66, 68. A central extension 70 depends from top portion 64 in spaced relation between side portions 66, 68 to support a boss 72 having an aperture 74 therethrough.

Rod 58 is slidably disposed through aperture 74 in staple guide means 62, and a biasing means 76, such as a compression spring, preferably extends about rod 58 between staple guide means 62 and tubular handle 52. Tubular handle 52 is sized to substantially receive biasing means 76 therein when chamber 40 is fully loaded with a plurality of staples 14. Biasing means 76 is sized to linearly bias staple guide means 62 substantially towards the first open end portion 42 of chamber 40 in a manner to sequentially align each of the plurality of staples 14 disposed within chamber 40 in proximity to first open end portion 42. A retaining means 78 is preferably secured at end 80 of rod 58 to retain staple guide means on rod 58 when the staple advancing means 50 is removed from chamber 40 as shown in FIG. 1.

As shown in FIG. 8, staple support member 82 is secured to the bottom 32 of housing 30 within chamber 40 in spaced relation from top 88 and sides 84, 36. Preferably, staple support member 82 extends substantially the length of chamber 40 to support staples 14 as they are biased by the staple advancing means 50 towards first open end 42. Staple support member 82 is preferably formed with sides 84, 86 extending in spaced relation from sides 34, 36 of housing 30, with upper ends 88, 90 inclined towards each other in spaced relation in a manner to support the top portion 26 of staples 14. This allows staples of various lengths to be utilized without adversely affecting the actuation of staple insertion apparatus 10. The space 92 between upper ends 88, 90 allows central extension 70 of staple guide means 62 to be slidably received therebetween. Staple guide means 62 is supported upon ends 88. 90 of staple support member 82 which serves to align staple guide means 62 in relation to the plurality of staples 14, regardless of staple length.

A housing support member 94 is secured to housing 30 in proximity to the first open end portion 42. Housing support member 94 is preferably secured to housing 80 in proximity to the first open end portion 42. Housing support member 94 may be fabricated of one or more pieces, and extends above housing 30 to secure a vertically disposed tubular member 96 in spaced relation above the first open end portion 42 of chamber 40.

A staple retaining means 97, 98 serves to limit the travel of staples 14 in a manner to align the staple 14 closest to the first open end portion 42 beneath the staple drive member 100. Staple drive member 100 is sized to be slidably received between staple retaining means 97, 98 and the first open end portion 42 of chamber 40. Preferably, the bottom portion of drive member 100 is contoured to the general configuration of the top portion 26 of each staple 14. Staple retaining means 97, 98 may be secured to housing 30, or to housing support member 94 in accordance with manufacturing preference. Preferably, housing support member 94 is formed to the configuration of staple retaining means 97, 98.

Staple drive member 100 is secured to an elongated drive member 102. Elongated drive member 102 is slidably received within tubular member 96, and extends above tubular member 96, as best shown in FIG. 2.

A foot actuation member 104 may be secured to the elongated drive member 102 at a location below tubular member 96. Foot actuation member 104 is preferably releasably secured to elongated drive member 102 to allow alternate positioning of the foot actuation member 104 for use from the operator's left or right side, according to the operator's preference.

Figure 4:
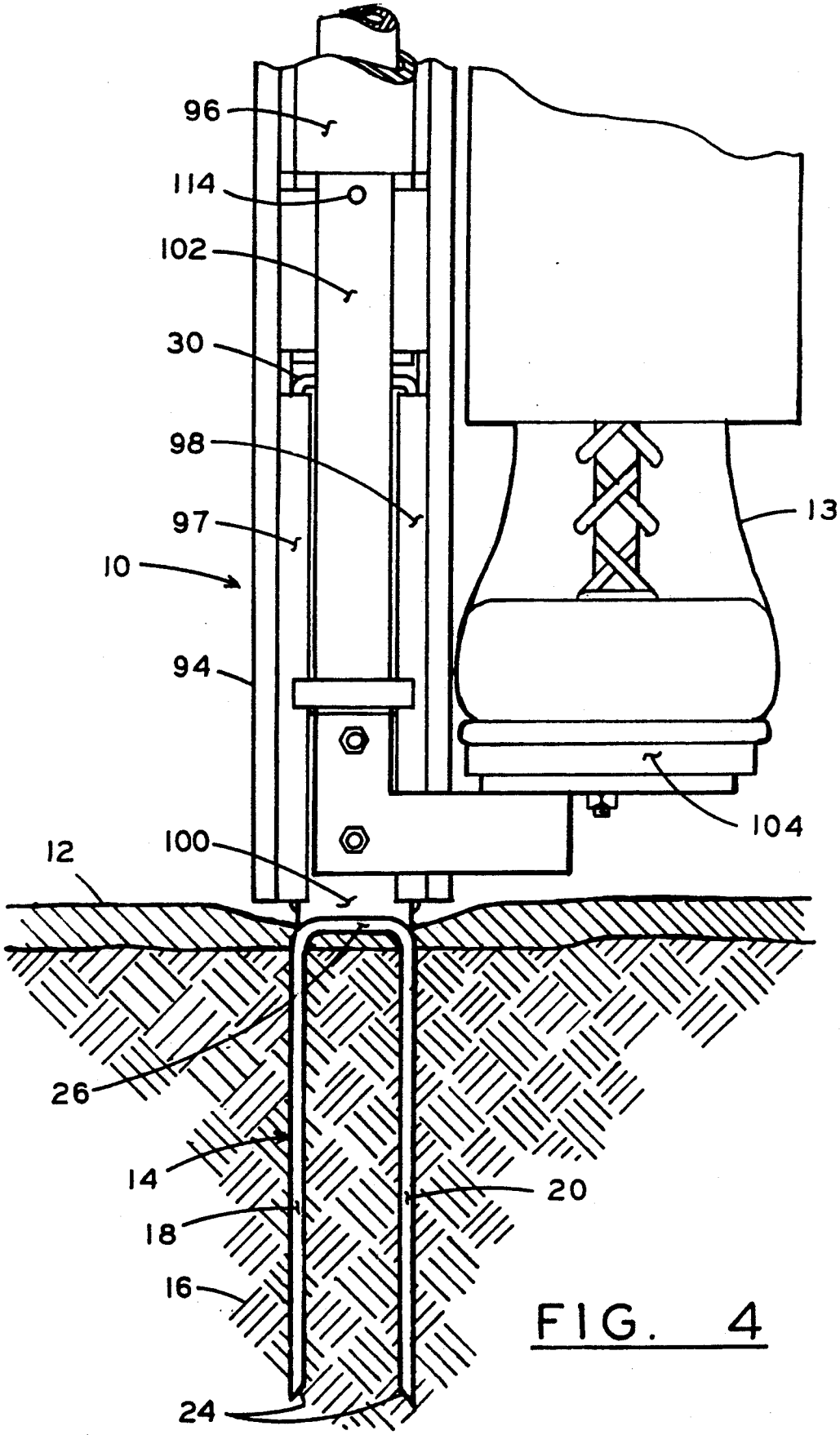
FIG. 4 is an end view of the staple insertion apparatus, with the drive member positioned in the lower operating position.

Referring now to FIG. 1 and FIG. 2, a first biasing means 106 is slidably disposed upon elongated drive member 102, between the upper end 107 of tubular member 96 and a stop 109. Stop 109 is secured to elongated drive member 102 to allow drive member 102 to be biased between an upper operating position where the drive member 102 is above the first open end portion of chamber 40, and a lower operating position where the driVe member 102 is extended substantially across the first open end portion of chamber 40. The stop 109 is preferably secured to drive member 102 in a manner to restrict the staple drive member 100 from extending substantially below the bottom 32 of housing 30, as best shown in FIG. 4.

Handles 122, 123 are preferably secured to drive member 102 above stop 109, at right angles to drive member 102. Handles 122, 123 preferably extend from each side of the elongated drive member 102 to provide opposed gripping surfaces on opposite sides of the elongated drive member 102. The opposed handles 122. 123 center the downward force applied upon the handles by the operator about the drive member 102.

The first biasing means 106 acts against the upper end 97 of tubular member 96 and stop 109 to raise drive member 102 to the upper operating position, in preparation for insertion of the next staple 14.

As the operator exerts a substantial downward force upon the handles 122, 123 with his hands, or upon the foot actuation member 104 with his foot, or a combination of hands and feet, the elongated drive member 102 is linearly biased towards the ground. The downward force drives the staple drive member 100 against the top portion of the staple 14 aligned beneath the staple drive member 100, forcibly separating staple 14 from the remaining staples disposed upon staple support member 82, to forcibly drive the separated staple 14 through the selected material 12, into the ground.

As staple 14 is driven into the ground, the first biasing member 106 is compressed. Upon completion of the downward force applied by the operator, the biasing member 106 expands to raise the drive member 102 to the upper operating position shown in FIG. 1 and 2.

A cap 120 may be secured to the upper end of elongated drive member 102 to stop foreign material from entering into elongated drive member 102. Likewise, the bottom portion of elongated drive member 102 may be plugged, or otherwise closed off to stop foreign material from entering elongated drive member 102.

Staple support member 82 may also be closed off in proximity to end 42 of chamber 40. However, the space between sides 84, 86 of staple support member 82 and sides 34, 36 of chamber 40 must remain sufficiently open to allow passage of staple 14 closest to end 42 to abut staple retaining means 97, 98 in order to properly align staple 14 beneath staple drive member 100, when the drive member 102 is raised into the upper operating position.

Operator 13 may easily move and reposition the staple insertion apparatus 10 with handles 122, 123 in preparation for insertion of the next staple 14. By use of a downward force upon handles 122, 123, or upon foot actuation member 104, or both, the operator 13 may drive the staple 14 into the ground. As the downward force is released, the first biasing means 106 raises the elongated drive member 102, which also raises staple drive member 100, foot actuation member 104, stop 109 and handles 122, 123, in preparation for subsequent staple insertion.

The operator 13 may then move several strides to the next staple insertion location and repeat the staple insertion procedure, to sequentially insert each of a plurality of staples disposed within chamber 40 through material 12, thereby covering a great expanse of material 12, in a very short time.

When all the staples 14 in chamber 40 have been sequentially inserted, operator 18 may quickly reload the next plurality of staples within chamber 40 by releasing retaining means 60 and withdrawing staple advancing means 50 from chamber 40. Operator 13 may then load the next plurality of staples 14 within chamber 40 and insert staple advancing means 50 into chamber 40 to bias staples 14 towards the first open end portion 42 of chamber 40. Staple advancing means 50 is then secured to housing 30 with retaining means 60, in preparation for further use.

Thus, while the novel staple insertion apparatus has been fully described and disclosed, numerous modifications will become readily apparent to one of ordinary skill in this art, and such adaptations and modifications are intended to be included within the scope of the following claims.

What is claimed is:

1. A staple insertion apparatus, which comprises:

a) a chamber formed within a housing having a bottom, opposing sides and a top portion, the chamber having first and second open end portions sized to receive a plurality of generally U-shaped staples therein;

b) a vertically disposed tubular member secured to the housing above the first open end portion of the chamber;

c) an elongated drive means slidably disposed within the tubular member, with the upper end extending above the tubular member and a handle secured to the upper end of the drive means;

d) a staple retaining means disposed in spaced relation beyond the first open end portion of the chamber and positioned to locate the forward most staple beneath the elongated drive means;

e) a staple drive member secured to the lower portion of the elongated drive means and slidably disposed between the first open end portion of the chamber and the staple retaining means, the staple drive member having a staple confronting portion configured to generally conform to the external profile of the top of the generally U-shaped staples;

f) a staple support member secured within the chamber to the housing bottom, with sides extending in spaced relation from the housing sides and top and the sides of the staple support member extending substantially the length of the chamber to support a plurality of generally U-shaped staples thereon;

g) a staple advancing means, releasably secured to the housing about the second open end portion of the chamber, for urging the plurality of staples within the chamber towards the first open end portion of the chamber;

h) a stop secured to the elongated drive means below the handle at a height sufficient to allow movement between first and second operating positions, while restricting the staple drive member from extending substantially below the bottom of the housing;

i) a biasing member disposed about the elongated drive means between the stop and the tubular member, to raise the drive means from a lower operating position to an upper operating position;

wherein the staple insertion apparatus is positioned upon a selected material and a substantial downward force is applied to bias the drive means from the upper operating position to the lower operating position to drive the forward most staple through the selected material and into the ground; and the staple advancing means urges the plurality of staples towards the first open end portion of the chamber as the downward force is released, in preparation for insertion of the next staple.

2. The apparatus of claim 1, wherein a foot actuation member is releasably secured to the drive means at a location beneath the tubular member, and selectively positioned to extend to either side of the housing in accordance with the preference of an operator.

3. The apparatus of claim 1, wherein the handle is secured to the elongated drive means at right angles to the elongated drive means and the handle extends from each side of the elongated drive means to provide opposed gripping surfaces on opposite sides of the elongated drive means.

4. The apparatus of claim 1, wherein an elongated protective sleeve is secured to the drive member and slidably disposed about a portion of the tubular member to substantially enclose and protect the biasing member during use.

5. The apparatus of claim 1, wherein the first biasing means may be pre-assembled upon the elongated drive means, and secured in place with the stop prior to shipping, and the handle may be releasably secured to the elongated drive means above the stop, prior to use.

6. The apparatus of claim 1, wherein the staple advancing means comprises: an end closure member sized to substantially enclose the second open end portion of the chamber, with a tubular handle portion externally secured to the end closure member in alignment with an aperture disposed through the end closure member; an elongated rod secured to the tubular handle portion and extending substantially the length of the chamber when the staple advancing means is releasably secured to the housing; a staple guide means configured With a top portion, and adjoining side portions depending from the top portion, with a central extension depending from the top portion in spaced relation between the side portions, with a aperture disposed through the central extension and slidably disposed upon the elongated rod; and a second biasing means disposed upon the elongated rod between the tubular handle portion and the staple guide means; wherein the second biasing means is configured to extend the staple guide means substantially the length of the chamber when the staple advancing means is releasably secured to the housing, and the second biasing means is substantially compressed within the tubular handle when the chamber is fully loaded with a plurality of staples.

7. A staple insertion apparatus for sequentially inserting a plurality of staples through a selected material into the ground, when actuated with a substantial downward force by an operator, which comprises:

a) an elongated housing having a bottom, opposing sides and a top, forming a chamber therebetween with first and second open end portions, the chamber sized to receive the plurality of staples therein;

b) a vertically disposed tubular member secured to the housing above the first open end portion of the chamber;

c) an elongated drive means slidably disposed partially within the tubular member above the first open end portion of the chamber when the drive means is disposed in an upper operating position, and extending substantially across the first open end portion of the chamber when the drive means is disposed in the lower operating position;

d) a handle secured to the elongated drive means at right angles from the elongated drive means, the handle extending from each side of the elongated drive means to provide opposed gripping surfaces on opposite sides of the elongated drive means;

e) a first biasing member disposed about the elongated drive means between the handle and the tubular member, to raise the drive means from the lower operating position to the upper operating position;

f) a staple retaining means disposed in spaced relation from the first open end portion of the chamber to position one of the plurality of staples for insertion beneath the drive means;

g) a staple drive member secured to the elongated drive means below the tubular member, the staple drive member slidably disposed between the first open end portion of the chamber and the staple retaining means, with the staple confronting portion of the staple drive member configured to generally conform to the external profile of the top portion of one of the generally U-shaped staples:

h) a staple advancing means, releasably secured to the housing about the second open end portion of the chamber, for urging the plurality of staples towards the first open end portion of the chamber; and i) a foot actuation member secured to the elongated drive member below the tubular member, and extending from the tubular member;

wherein the operator positions the staple insertion apparatus upon the selected material, and exerts a substantial downward force upon the handle, the foot actuation member, or both, to drive a staple through the selected material, into the ground, and upon release of the substantial downward pressure, the first biasing member raises the drive means to the upper operating position, as the staple advancing means biases the plurality of staples towards the first open end portion of the chamber in preparation for insertion of the next staple.

8. The apparatus of claim 7, wherein a stop is secured to the elongated drive means beneath the handle and above the first biasing means at a height sufficient to allow movement between upper and lower operating positions, while restricting the staple drive member from extending substantially below the bottom of the housing.

9. The apparatus of claim 8, wherein the first biasing means may be pre-assembled upon the elongated drive means, and secured in place with the stop prior to shipping, and the handle may be releasably secured to the drive means above the stop prior to use.

10. The apparatus of claim 7, wherein the foot actuation member is releasably secured to the drive member, and selectively positioned to extend to either side of the housing in accordance with the operator's preference.

11. The apparatus of claim 7, wherein an elongated, protective sleeve is secured to the drive member and slidably disposed about a portion of the tubular member to substantially enclose and protect the biasing member during use.

12. The apparatus of claim 7, wherein the tubular member is secured to a housing support member, which is secured to the housing in proximity to the first open end portion of the chamber.

13. A staple insertion apparatus, for sequentially inserting a plurality of staples through a selected material into the ground, when actuated by an operator from a standing position, which comprises:

a) an elongated housing having a bottom portion, opposing side portions and a top portion forming a chamber therebetween, with first and second open end portions, the chamber sized to receive the plurality of staples therein;

b) a vertically disposed tubular member secured to the housing above the first open end portion of the chamber;

c) an elongated drive means slidably disposed partially within the tubular member above the first open end portion of the chamber when the drive means is in an upper operating position, and extending substantially across the first open end portion of the chamber when the drive means is disposed in a lower operating position, the drive means further having a handle secured at its upper end;

d) a foot actuation member secured to the drive means beneath the tubular member, and extending from the drive means;

e) a first biasing member disposed about the elongated drive means between the handle and the tubular member, to raise the drive means from the lower operating position to the upper operating position;

f) a staple retaining means disposed in spaced relation from the first open end portion of the chamber to position one of the plurality of staples for insertion beneath the drive means;

g) a staple support member secured within the chamber to the housing bottom, with sides extending in spaced relation from the housing sides and top, the sides of the staple support member extending substantially the length of the chamber, and positioned to support a plurality of generally U-shaped staples thereon;

h) and a staple advancing means, releasably secured to the housing about the second open end portion of the chamber, for urging the plurality of staples within the chamber towards the first open end portion of the chamber;

wherein, the operator positions the staple insertion apparatus upon the selected material, and exerts a substantial downward force from a standing position upon the handle, the foot actuation member, or both, to drive the staple through the selected material, into the ground, and upon release of the substantial downward pressure, the biasing member raises the drive means to the upper operating position, as the staple advancing means biases the plurality of staples towards the first open end portion of the chamber in preparation for insertion of the next staple.

14. The apparatus of claim 13, wherein the foot actuation member is releasably secured to the drive member, and selectively positioned to extend to either side of the housing in accordance with the operator's preference.

15. The apparatus of claim 13, wherein an elongated protective sleeve is secured to the drive member and slidably disposed about a portion of the tubular member to substantially enclose and protect the first biasing member during use.

16. The apparatus of claim 13, wherein a staple drive member is secured to the elongated drive means, with the staple drive member slidably disposed between the first open end portion of the chamber and the staple retaining means, with the staple confronting portion of the staple drive member configured to generally conform to the external profile of the top portion of one of the generally U-shaped staples.

17. The apparatus of claim 16, wherein a stop is secured to the elongated drive means beneath the handle at a height sufficient to allow movement between upper and lower operating positions, while restricting the staple drive member from extending substantially below the bottom of the housing.

18. The apparatus of claim 13, wherein the staple advancing means comprises: an end closure member sized to substantially enclose the second open end portion of the chamber, with a tubular handle portion externally secured to the end closure member in alignment with an aperture disposed through the end closure member; an elongated rod secured to the tubular handle portion and extending substantially the length of the chamber when the staple advancing means is releasably secured to the housing; a staple guide means configured with a top portion and adjoining side portions depending from the top portion, with a central extension depending from the top portion in spaced relation between the side portions, an aperture disposed through the central extension and slidably disposed upon the elongated rod; and a second biasing means disposed upon the elongated rod between the tubular handle portion and the staple guide means; wherein the second biasing means is configured to extend the staple guide means substantially the length of the chamber when the staple advancing means is releasably secured to the housing, and the second biasing means is substantially compressed within the tubular handle when chamber is fully loaded with a plurality of staples.

19. The apparatus of claim 13, wherein the handle is secured to the elongated drive means at right angles from the elongated drive means and the handle extends from each side of the elongated drive means to provide opposed gripping surfaces on opposite sides of the elongated drive means during use.

20. The apparatus of claim 13, wherein a housing support member is secured to the housing in proximity to the first open end portion, and extends above the housing to secure the vertically disposed tubular member above the first open end portion of the chamber.

* * * * *